US006727789B2

(12) United States Patent
Tibbetts et al.

(10) Patent No.: US 6,727,789 B2
(45) Date of Patent: Apr. 27, 2004

(54) MAGNETIC TRANSDUCERS OF IMPROVED RESISTANCE TO ARBITRARY MECHANICAL SHOCK

(75) Inventors: George C. Tibbetts, Camden, ME (US); John L. Burns, Camden, ME (US); Joseph A. Sawyer, Camden, ME (US)

(73) Assignee: Tibbetts Industries, Inc., Camden, ME (US)

( * ) Notice: Subject to any disclaimer, the term of this patent is extended or adjusted under 35 U.S.C. 154(b) by 20 days.

(21) Appl. No.: 09/879,331

(22) Filed: Jun. 12, 2001

(65) Prior Publication Data

US 2002/0186110 A1 Dec. 12, 2002

(51) Int. Cl.[7] ..... H01H 7/00
(52) U.S. Cl. ..... 335/220; 335/235; 381/412
(58) Field of Search ..... 335/220–229, 335/231–236, 261–273; 381/412–413, 417

(56) References Cited

U.S. PATENT DOCUMENTS 3,515,818 A 6/1970 Tibbetts
3,617,653 A 11/1971 Tibbetts et al.
4,272,654 A * 6/1981 Carlson ..... 381/417
5,647,013 A 7/1997 Salvage et al.
5,757,947 A * 5/1998 VanHalteren et al. ..... 381/200
5,809,158 A * 9/1998 VanHalteren et al. ..... 381/200

FOREIGN PATENT DOCUMENTS

EP 0847226 6/1998
WO 01/26413 4/2001

* cited by examiner

*Primary Examiner*—Lincoln Donovan
(74) *Attorney, Agent, or Firm*—Lahive & Cockfield, LLP

(57) ABSTRACT

The armature of an electromagnetic transducer, extending through the polarizing flux between opposing permanent magnet pole faces, is snubbed to limit its shock-induced excursions normal to the directions of its extent and of the flux field. Such snubbing helps to protect the armature from plastic damage and accompanying shift of magnetic balance of the transducer upon the occurrence of a strong mechanical shock in an arbitrary direction.

11 Claims, 3 Drawing Sheets

MAGNETIC TRANSDUCERS OF IMPROVED RESISTANCE TO ARBITRARY MECHANICAL SHOCK

BACKGROUND OF THE INVENTION

This invention relates generally to balanced moving armature magnetic transducers, and particularly to means for protecting the moving armature from damage affecting the operating characteristics of a transducer caused by mechanical shock.

In contemporary balanced moving armature magnetic transducers, the element or elements comprising the armature usually function as its own restoring spring, providing mechanical stability and approximate magnetic balance of the armature in its quiescent state. Usually a portion of the armature is surrounded by an electrical signal coil, and functions to convey magnetic signal flux through the coil. Consequently the armature is required to have high magnetic permeability and low coercive force, in addition to providing a restoring spring function.

When materials for armatures are heat treated to develop their magnetic properties, they generally have limited mechanical yield strength. This limits the strength of the armature in its restoring spring function. The resistance to mechanical shock of a magnetic transducer having an armature of such materials is undesirably limited. In particular, a shock from an external source may easily and irreversibly alter the position of the armature by plastic damage, thus destroying its magnetic balance.

The foregoing problem is encountered by the hearing aid or hearing instrument art, in which the sound output generating devices (called receivers) are commonly fabricated using balanced moving armature magnetic transducer technology. In fact, susceptibility to mechanical shock is presently considered the second most likely cause of failure in the field, and failure of the receiver causes failure of the entire hearing aid.

Past efforts have attempted to increase the shock resistance of these transducers by the use of snubbing structures that limit the extent of movement or excursion of the vibratory part of the armature when subjected to shock. For example, U.S. Pat. No. 4,272,654 to Carlson discloses plural discrete ridges or continuous ridges formed of coil encapsulant as snubbing means for the inner arm of a folded armature of the general type disclosed in U.S. Pat. No. 3,515,818 to one of the present applicants. U.S. Pat. Nos. 5,647,013 to Salvage et al and 5,757,947 to Van Halteren et al disclose snubbing means for an armature of the general type disclosed in U.S. Pat. No. 3,617,653 to Tibbetts et al. U.S. Pat. No. 5,647,013 discloses several forms of snubbing means including formations pressed in and away from the plane of the armature body, or blobs of adhesive or other settable material applied to the armature, or a spacer having a restricted opening situated between the coil and the permanent magnet structure, or means for altering the shape of the coil tunnel. U.S. Pat. No. 5,757,947 discloses snubbing means forming a part of the drive pin structure connecting the transducer with a diaphragm, or alternatively a U-shaped element disposed on the side of the magnet elements facing away from the coil. These various snubbing means are provided at designated locations of the armature, but in all cases the direction of snubbing is parallel with the drive pin, i.e., directed to limit the excursion of the armature in the direction of the permanent magnetic flux. In general, this direction is normal to a major plane of the armature.

Analysis of mechanical shocks has found the effects to be complex and dependent on the vector direction of the shock. Instrinsically, a shock of external origin may have any arbitrary direction, as exemplified by a hearing aid inadvertently dropped to the floor. The present applicants have found that the full effect of a given shock upon the subsequent operating properties, and also the subsequent resistance to other shocks, is considerably dependent on the direction of the original shock as well as its magnitude. They have further found that snubbing of the armature in the direction of the drive pin, which may be provided intrinsically by the magnets or pole pieces or by means such as those described in the above-mentioned patents, only partially protects the armature from damage. This is particularly the case for folded armatures of the general type described in U.S. Pat. No. 3,515,818.

SUMMARY OF THE INVENTION

It has been discovered that when a basic folded armature transducer of the general type disclosed in U.S. Pat. No. 3,515,818 is shocked in the edgewise direction, i.e. the direction normal to that of the flux field and normal to the direction of extent of its vibratory portion, with or without parallel protective snubbing as described above, significant plastic damage to the armature readily occurred, although in this particular case there appeared to be little shift in the magnetic balance of the transducer. However, the damage to the armature significantly compromised the resistance of the transducer to a shift of magnetic balance under a subsequent shock in a different vector direction. This led to the conclusion that the armature should be snubbed in this edgewise direction of shock, hereinafter referred to as edgewise snubbing.

Analysis was then given to a determination of the degree of edgewise snubbing that would be sufficient to protect the armature not only for edgewise shocks in the direction normal to the magnetic flux and to the direction of extent of the vibratory portion of the armature but also for shocks in other possible vector directions. Analysis determined that for a shock of given magnitude in the edgewise direction, a corresponding edgewise snubbing clearance (the space between the relevant edges of the armature and the snubbing means) could be determined such that the armature would survive elastically. However, it was further found that such degree of edgewise snubbing was not sufficient to protect the armature, and to avoid shift of magnetic balance, under shocks of the same magnitude but in other equally possible vector directions. In fact, it was determined that the edgewise snubbing clearance was required to be reduced by a large factor, for example on the order of three, to provide sufficient practical protection.

Based on the foregoing observations, the features of the present invention include the provision of specific snubber means having a surface or surfaces oriented to limit the edgewise excursions of the armature, i.e. normal to the direction of the permanent magnetic flux and to the direction of extent of the vibratory portion of the armature.

Various means may be provided for this edgewise snubbing, including means limiting the excursions of the armature in the direction normal to both the direction of the magnetic flux and the direction of extent of the vibratory portion of the armature.

The edgewise snubbing means of the invention may take any of several forms including filler pieces or a member having opposed surfaces between which the armature is extended, in either case to provide a desired edgewise snubbing clearance.

DETAILED DESCRIPTION

Figure 1:
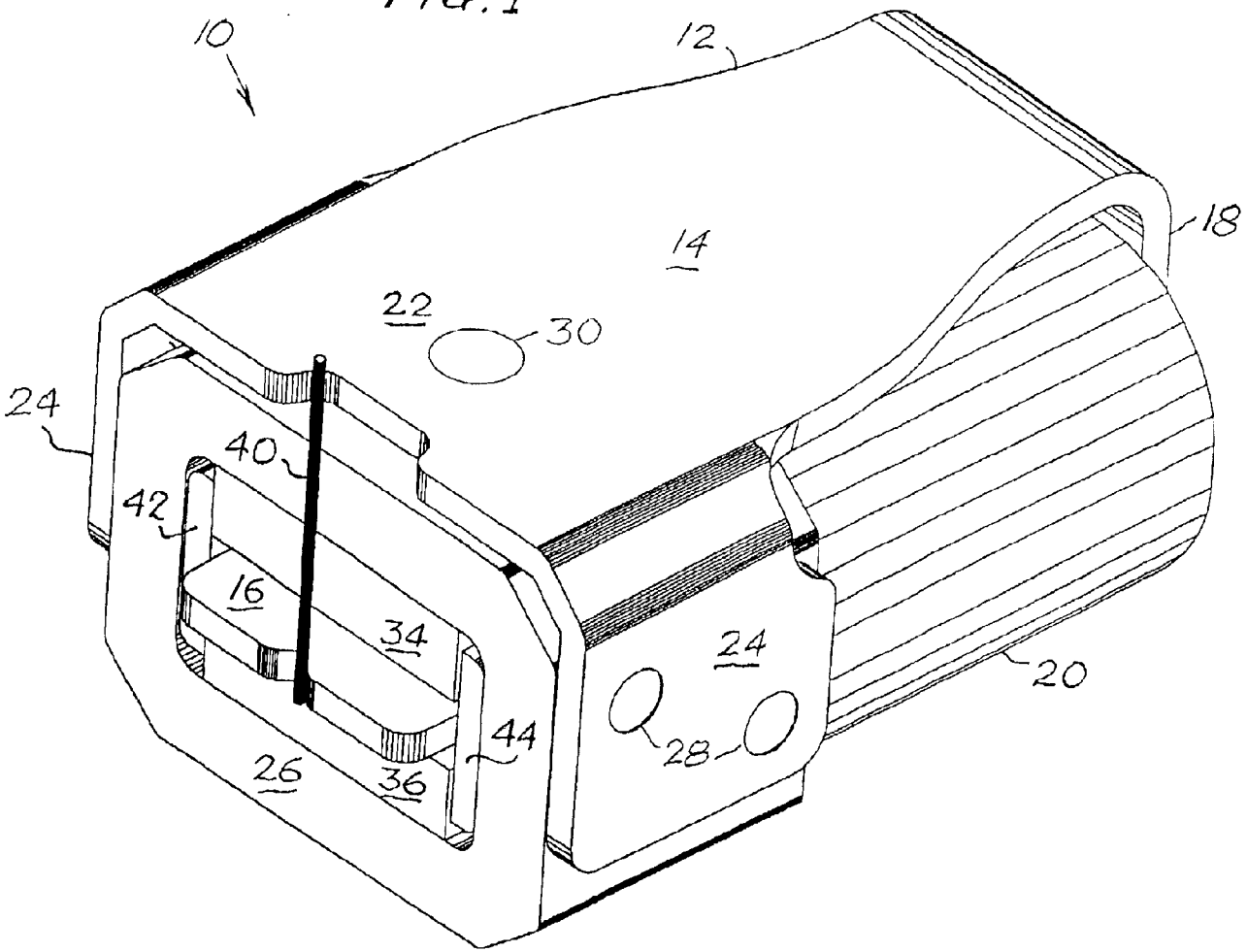
FIG. 1 is an isometric view of a first embodiment of a folded armature transducer embodying the invention.
Figure 2:
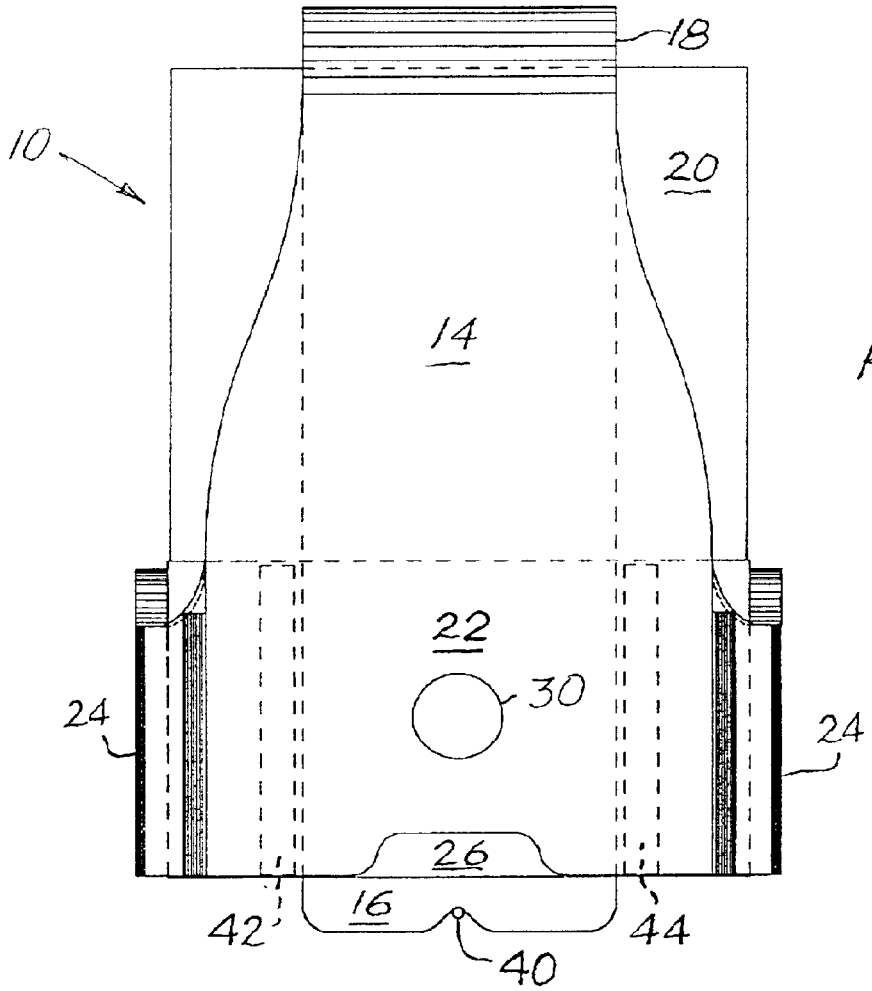
FIG. 2 is a plan view of the embodiment of FIG. 1.
Figure 3:
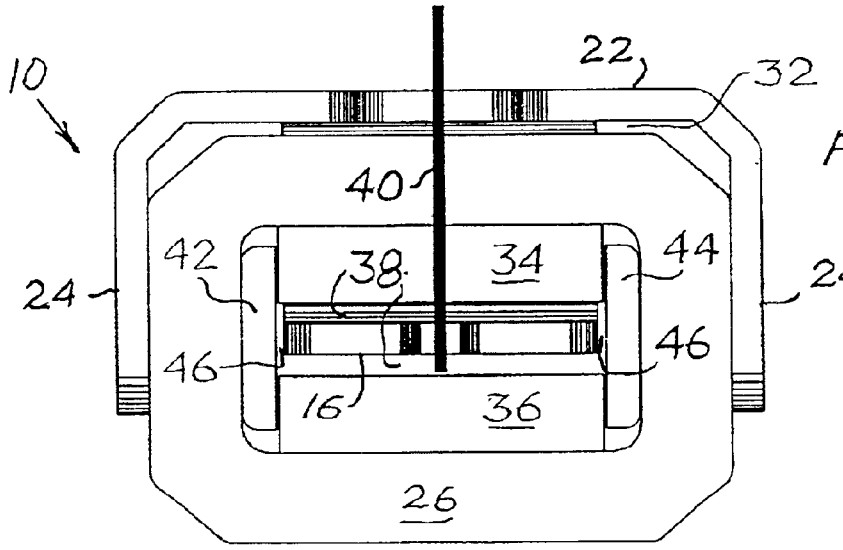
FIG. 3 is a front elevation of the embodiment of FIG. 1.

FIGS. 1 to 3 illustrate a transducer motor unit 10 of the general type disclosed in copending U.S. application Ser. No. 09-779,920, filed Feb. 8, 2001 and assigned to the same assignee as the present application. An armature 12 is formed from a flat strip of magnetically permeable sheet material and folded, and thereafter heat treated, to form an elongate supported but vibratory outer arm 14, an elongate vibratory inner arm 16, and an integral connecting portion 18. The arm 16 extends through the bore of an electrical signal core 20. The arm 14 is supported by a bridge 22, the bridge being integrally formed with and supported by wings or pads 24 welded to a magnet strap 26 by welds 28. If desired, a hole 30 through the thickness of the bridge 22 may be formed, and epoxy adhesive may be fed through the hole into a clearance space 32 between the facing surfaces of the bridge 22 and the magnet strap 26. After curing, this adhesive helps to sustain the shock resistance of the armature 12, particularly against shock components in the vertical (parallel) direction as viewed in FIG. 3.

The inner arm 16 of the armature extends into a working gap between permanent magnets 34 and 36 which are respectively secured to the magnet strap 26. The working gap comprises a pair of gaps 38.

A drive pin 40 is welded into a notch in the outer end of the arm 16 and is extended to a diaphragm (not shown) forming a part of the transducer, as is well known.

Filler pieces 42 and 44 are bonded by adhesive against the inside vertical walls of the magnet strap 26. Their thickness is chosen to provide predetermined snubbing clearances from the respective lateral facing edges of the arm 16. In addition, the filler pieces may serve to locate the magnets 34 and 36 when they are adhesively bonded into the magnet strap 26. In assembly of the transducer, care is taken to center the arm 16 with edgewise precision relative to the magnet strap so that after the welding of the pads 24 to the magnet strap, the clearances 46 are substantially equal.

Figure 4:
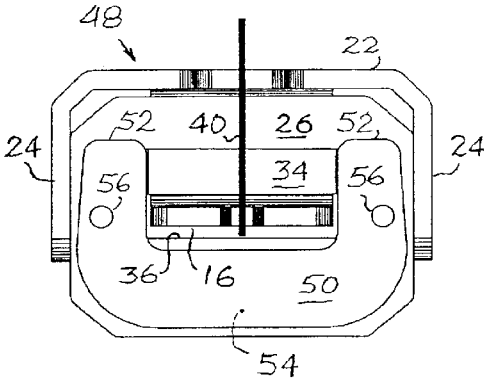
FIG. 4 is a front elevation of a folded armature transducer incorporating a second embodiment of the invention.
Figure 5:
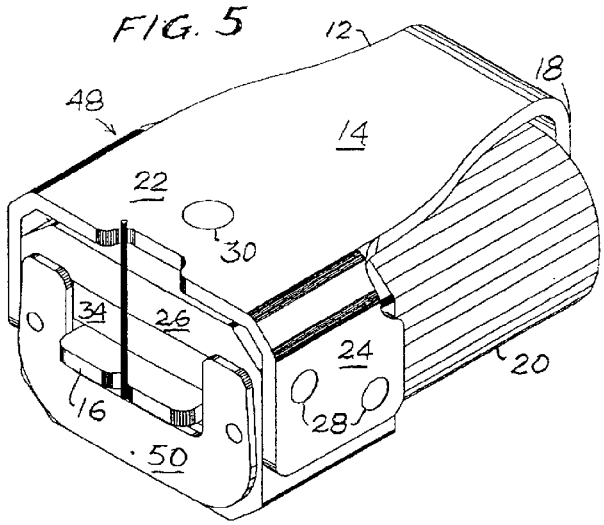
FIG. 5 is an isometric view of the embodiment of FIG. 4.
Figure 6:
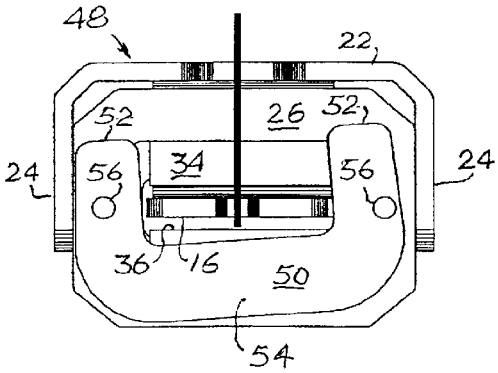
FIG. 6 is a front elevation illustrating a variation in the assembly of the embodiment of FIG. 4.

FIGS. 4 to 6 illustrate a transducer 48 having a different form of edgewise snubbing adapted for aiding in centering the snubbing means with respect to the arm 16 to provide substantially equal edgewise clearances corresponding to the clearances 46. In these figures, the same reference numerals as those applied to FIGS. 1 to 3 refer to the parts of the same construction as described in the latter embodiment.

In this embodiment a U-shaped snubber 50, having mutually spaced arms 52 and formed by blanking from a strip of metal is initially attached to the magnet strap 26 by a small resistance weld 54. In the fabrication of the transducer 48 a subassembly is first completed by adhesively securing the magnets 34 and 36 to the inner surfaces of the magnet strap 26, and preferably at this stage the snubber 50 is attached to the magnet strap by making the weld 54 with the snubber 50 centered on the aperture of the magnet strap. FIG. 4 shows the subsequent assembly of these parts with the armature 12 in place and with the arm 16 observed to be equally centered between the arms 52 of the snubber. Strong laser welds 56 are then made to secure the snubber 50 permanently to the magnet strap.

If desired, the snubber may be of closed washer shape rather than U-shape as illustrated.

FIG. 6 illustrates the same embodiment as that of FIG. 4 in the event that the end of the arm 16 is assembled significantly off center edgewise relative to the subassembly comprising the magnet strap 26, the magnets 34 and 36 and the snubber 50. In this case the snubber 50 is rotated in its plane by plastically twisting the weld 54 until the edgewise clearances of the arm 16 from the arms 52 of the snubber are approximately equalized, as shown. Then the assembly is finished by making the laser welds 56.

Although the illustrated embodiments of the invention are shown without snubbing means of the parallel types shown in the above-mentioned patents, such additional snubbing means may be added to the structures in combination with the edgewise snubbing of this invention to provide the necessary protection of the armature from damage by mechanical shocks.

Edgewise snubbing means according to this invention may be included not only in transducers having folded armatures of the general type disclosed in the above mentioned U.S. Pat. No. 3,515,818, but also transducers having other types of armatures, including for example those of the general type disclosed in the above mentioned U.S. Pat. No. 3,617,653.

We claim:

1. An electromagnetic transducer having, in combination, permanent magnet means forming a flux field extending in a direction between opposing pole faces across a working gap, an electrical signal coil, an elongate armature supported at one end thereof, extending through said coil and having its other end extending into said gap, said other end being vibratory in said direction, said other end having surfaces respectively opposing said pole faces and joined by a pair of lateral edges, a first snubber having a pair of surfaces respectively oriented to limit deflections of said other end in both directions parallel to the direction of the flux field, and a second snubber having portions thereof affixed to the permanent magnet means, said portions having a pair of surfaces respectively forming predetermined clearances from said pair of lateral edges to limit deflections of said other end of the armature in both directions perpendicular to the direction of the flux field.

2. A transducer according to claim 1, wherein said one end of the armature comprises an outer arm extending from the permanent magnet means generally parallel to said other end, and a connecting portion integral with and connecting between said ends.

3. A transducer according to claim 1, wherein the second snubber comprises filler pieces respectively attached to the permanent magnet means in position to form said clearances.

4. A transducer according to claim 3, wherein the permanent magnet means comprise a magnet strap and a pair of permanent magnets attached to the strap, the filler pieces being attached to said strap.

5. A transducer according to claim 4, wherein the magnet strap forms a closed loop, the second snubber comprising two said filler pieces in facing relation secured to and within said loop.

6. A transducer according to claim 4, wherein the filler pieces extend between the strap and sides of the magnets for locating the magnets within the strap when being attached thereto.

7. A transducer according to claim 1, wherein the second snubber comprises a unitary member attached to the permanent magnet means and having spaced, mutually facing parallel snubbing surfaces with the armature extending therebetween.

8. A transducer according to claim 7, wherein the permanent magnet means comprise a magnet strap and a pair of permanent magnets attached to the strap, said unitary member being attached to the magnet strap.

9. A transducer according to claim 8, in which the unitary member has a plastically deformable attachment to the magnet strap for preliminary rotational adjustment of said parallel surfaces about an axis normal to said direction.

10. A transducer according to claim 9, in which the unitary member has rigid attachments to the magnet strap in the vicinities of said parallel surfaces.

11. A transducer according to claim 1, including a diaphragm drive pin extending from said other end of the armature and vibratory thereby in the direction of the flux field.

* * * * *